US007351685B2

(12) United States Patent
Ohtawa et al.

(10) Patent No.: US 7,351,685 B2
(45) **Date of Patent: *Apr. 1, 2008**

(54) SOFTENER COMPOSITION

(75) Inventors: Yasuki Ohtawa, Wakayama (JP); Tohru Katoh, Wakayama (JP); Uichiro Nishimoto, Wakayama (JP); Yoshio Hatayama, Wakayama (JP); Yohei Kaneko, Wakayama (JP)

(73) Assignee: Kao Corporation, Tokyo (JP)

( * ) Notice: Subject to any disclaimer, the term of this patent is extended or adjusted under 35 U.S.C. 154(b) by 33 days.

This patent is subject to a terminal disclaimer.

(21) Appl. No.: 10/368,374

(22) Filed: Feb. 20, 2003

(65) Prior Publication Data

US 2003/0176312 A1 Sep. 18, 2003

Related U.S. Application Data

(62) Division of application No. 09/700,498, filed as application No. PCT/JP99/02619 on May 19, 1999, now Pat. No. 6,541,444.

(30) Foreign Application Priority Data

May 20, 1998 (JP) ..... 10-138701
Jun. 10, 1998 (JP) ..... 10-162329

(51) Int. Cl.
*C11D 1/825* (2006.01)

(52) U.S. Cl. ..... 510/527; 510/522

(58) Field of Classification Search ..... 510/515, 510/499, 501, 520, 522, 527
See application file for complete search history.

(56) References Cited

U.S. PATENT DOCUMENTS

| | | | | |
|---|---|---|---|---|
| 3,637,495 A | | 1/1972 | Eckert et al. | |
| 3,958,059 A | | 5/1976 | Diehl | |
| 4,222,905 A | | 9/1980 | Cockrell, Jr. | |
| 4,497,716 A | * | 2/1985 | Tai | 510/522 |
| 4,764,291 A | | 8/1988 | Steltenkamp et al. | |
| 5,282,983 A | * | 2/1994 | Yamamura et al. | 510/522 |
| 5,476,598 A | * | 12/1995 | Schramm, Jr. et al. | 510/522 |
| 6,211,139 B1 | * | 4/2001 | Keys et al. | 510/504 |
| 6,376,455 B1 | | 4/2002 | Friedli et al. | |
| 6,541,444 B1 | * | 4/2003 | Ohtawa et al. | 510/515 |

FOREIGN PATENT DOCUMENTS

| | | | |
|---|---|---|---|
| CA | 1205254 A | | 6/1986 |
| DE | 19 623 763 A | | 8/1998 |
| EP | 0 206 375 A1 | | 12/1986 |
| FR | 2743085 | * | 7/1997 |
| GB | 2134143 A | | 8/1984 |
| GB | 2197666 A | | 4/1988 |
| JP | 5-947477 A | | 3/1984 |
| JP | 59-130369 A | | 7/1984 |
| JP | 7-268773 A | | 10/1995 |
| WO | WO 99/27046 A1 | | 6/1999 |

* cited by examiner

*Primary Examiner*—John R. Hardee
(74) *Attorney, Agent, or Firm*—Birch, Stewart, Kolasch & Birch, LLP

(57) ABSTRACT

The present invention provides a softener composition which contains a softening base having an excellent softening effect and satisfactory biodegradability. That is, the present invention provides the softener composition which comprises (A) a nonionic compound which has at least one $C_{5-36}$ alkyl or alkenyl group and an amide bond but contains no dissociative group of amino or carboxyl group; and (B) at least one member selected among (B-α) cationic or ampholytic surfactants having one $C_{5-36}$ alkyl or alkenyl group or one optionally substituted aryl group and (B-β) amino compounds having at least one $C_{5-36}$ alkyl or alkenyl group and salts of the compounds.

18 Claims, No Drawings

SOFTENER COMPOSITION

This application is a divisional of Application No. Ser. 09/700,498 filed on Dec. 29, 2000, now U.S. Pat. No. 6,541,444 and for which priority is claimed under 35 U.S.C. § 120. Application Ser. No. 09/700,498 is the national phase of PCT International Application No. PCT/JP99/02619 filed on May 19, 1999 under 35 U.S.C. § 371. This application also claims priority of Application Nos. 10-138701 and 10-162329 filed in Japan on May 20, 1998 and Jun. 10, 1998, respectively, under 35 U.S.C. § 119. The entire contents of each of the above-identified applications are hereby incorporated by reference.

TECHNICAL FIELD

The present invention relates to a softener composition.

Background Art

Most of the commercially available merchandise as a softener composition for fibers are compositions comprising a quaternary ammonium salt containing two long-chain alkyl groups in one molecule, typically having a di(long chain alkyl) dimethyl ammonium chloride.

However, the quaternary ammonium salt described above suffers from the problem that, when residues thereof after a treatment are discharged into the environment, such as a river, most of them will accumulate and are not biodegradable.

As an improved product against the above-mentioned problem, N-methyl-N,N-bis(long chain alkanoyloxyethyl)-N-(2-hydroxyethyl) ammonium methyl sulfate, N,N-dimethyl-N,N-bis(alkanoyloxyethyl) ammonium chloride or the like is commercially available. Although the biodegradability of these products is better as compared with those products having the quaternary ammonium salt described above, the improved products still have insufficient softening effects.

DISCLOSURE OF INVENTION

Accordingly, the object of the present invention is to provide a softener composition which contains a softening base having an excellent softening effect and satisfactory biodegradability.

That is, the softener composition of the present invention contains a base having a satisfactory biodegradability and has an excellent softening effect.

The present invention provides a softener composition comprising (A) a nonionic compound which has at least one $C_{5-36}$ alkyl or alkenyl group and an amide bond but contains no dissociative group of amino or carboxyl group; and (B) at least one member selected among (B-α) cationic or ampholytic surfactants having one $C_{5-36}$ alkyl or alkenyl group or one optionally substituted aryl group and (B-β) amino compounds having at least one $C_{5-36}$ alkyl or alkenyl group and salts of the compounds; and it also provides a sheetlike softener for a dryer which is obtained by impregnating the softener composition into a sheetlike carrier.

Then, the softener composition of the present invention includes a composition wherein the component (A) has at least one $C_{5-22}$ alkyl or alkenyl group and the component (B) is (B-α) and has one $C_{7-22}$ alkyl or alkenyl group or one optionally substituted aryl group.

PREFERABLE MODES FOR CARRYING OUT THE INVENTION

The component (A) of the present invention is a nonionic compound which has at least one $C_{5-36}$ alkyl or alkenyl group and an amide bond but contains no dissociative group of amino or carboxyl group; it is preferably a nonionic compound represented by the formula (I), (II) or (III) (hereinafter, referred respectively to as the nonionic compound (I), (II) or (III)) or a mixture thereof; and it is more preferably the nonionic surfactant (I) or (II):

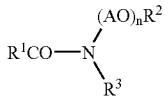

(I)

wherein $R^1$ represents a linear or branched $C_{5-35}$ alkyl or alkenyl group, $R^2$ represents a hydrogen atom or —$COR^1$, $R^3$ represents a hydrogen atom, a $C_{1-3}$ alkyl or hydroxyalkyl group, -$(AO)_mR^2$ or -A-$NHCOR^1$, A represents an ethylene or propylene group and each of n and m represents a number selected from 1 to 10;

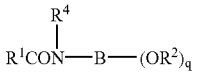

(II)

wherein each of $R^1$ and $R^2$ has the same meaning as defined above, $R^4$ represents a hydrogen atom, a $C_{1-3}$ alkyl or hydroxyalkyl group, B represents a group in which amino and hydroxyl groups are excluded from a $C_{3-6}$ amino polyol and q represents an integer of 2 to 5, provided that q·$R^2$'s are the same or different; and

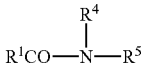

(III)

wherein each of $R^1$ and $R^4$ has the same meaning as defined above and $R^5$ represents a linear or branched $C_{1-36}$ alkyl, alkenyl, hydroxyalkyl or hydroxyalkenyl group.

For example, the nonionic compound (I) is synthesized by amidation of a secondary amino alcohol such as diethanol amine, diisopropanol amine, N-methylethanol amine, a diamino alcohol such as aminoethylethanol amine, an amino alcohol such as ethanol amine with a fatty acid or a lower alkyl ester thereof, and if necessary addition of an alkylene oxide such as ethylene oxide and propylene oxide thereto, followed by esterification of the resultant product. In the occasion, the amidation and esterification may be carried out at the same time. The degree of acylation in total is preferably 1 to 2.5 and more preferably 1.5 to 2.3. The number of carbon atoms in an acyl moiety in the fatty acid or the lower alkyl ester thereof used here is preferably 6 to 36 and more preferably 8 to 18. For example, a fatty acid from a coconut, a tallow fatty acid, a hardened (or hydrogenated) tallow fatty acid, stearic acid from a palm or hardened stearic acid from a palm, or a lower alkyl ester thereof is particularly preferable. Further, a fat and/or oil such as a coconut oil, a tallow, a hardened tallow, a palm-stearin and a hardened palm-stearin may also be used.

The nonionic compound (I) is preferably a compound represented by the following formula (Ia), (Ib), (Ic) or (Id) or a mixture thereof:

(Ia)

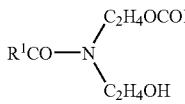

(Ib)

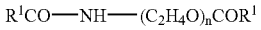

(Ic)

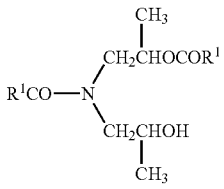

(Id)

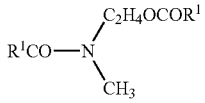

wherein each of $R^1$ and n has the same meaning as mentioned above.

For example, the nonionic compound (II) is synthesized by amidation of an amino polyol such as amino propanediol, N-methylglucamine with a fatty acid or a lower alkyl ester thereof, followed by esterification of the resultant product. The degree of acylation in total is preferably 1 to 2.5 and more preferably 1.5 to 2.3. The fatty acid or the lower alkyl ester thereof for use is preferably the above-mentioned one.

The nonionic compound (II) is preferably a compound represented by the following formula (IIa) or (IIb) or a mixture thereof:

(IIa)

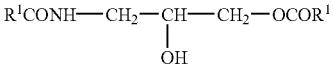

(IIb)

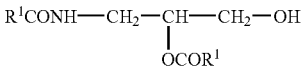

wherein $R^1$ has the same meaning as mentioned above.

For example, the nonionic compound (III) is synthesized by amidation of a long-chain fatty acid with a long-chain amine. The number of carbon atoms in the long-chain amine is preferably 6 to 36 and more preferably 8 to 18. For example, the long-chain amine is preferably a coconut amine, a tallow amine, a hardened tallow amine, a palm-stearin amine or a hardened palm-stearin amine, in particular. The fatty acid or the lower alkyl ester thereof for use is preferably the above-mentioned one.

The component (B) of the present invention is preferably a cationic surfactant represented by the formula (IV) (hereinafter, referred to as the cationic surfactant (IV)) or ampholytic surfactant represented by the formula (V) (hereinafter, referred to as the ampholytic surfactant (V)).

On the other hand, the component (B) of the present invention is preferably an amino compound represented by the formula (VI) or (VII) (hereinafter, referred respectively to as the amino compound (VI) or (VII)), a salt thereof or a mixture thereof:

(IV)

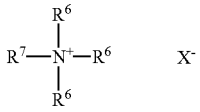

wherein $R^6$ represents a $C_{1-3}$ alkyl or hydroxyalkyl group, $R^7$ represents a linear or branched $C_{5-36}$ alkyl or alkenyl group, $—(C_pH_{2p})—Y—COR^8$ or $—(C_pH_{2p})—CO—Y—R^9$, p represents an integer of 1 to 6, Y represents O or NH, $R^8$ represents a linear or branched $C_{5-35}$ alkyl or alkenyl group or an optionally substituted aryl group, $R^9$ represents a linear or branched $C_{6-36}$ alkyl or alkenyl group or an optionally substituted aryl group and $X^-$ represents an anion, provided that 3·$R^6$'s are the same or different;

(V)

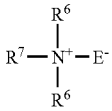

wherein each of $R^6$ and $R^7$ has the meaning as mentioned above, E represents $—R^{10}—Z$ or O, $R^{10}$ represents a $C_{1-6}$ alkylene or hydroxyalkylene group and Z represents —COO, $—OSO_3$, $—SO_3$, $—OPO_3$ or $—PO_3$;

(VI)

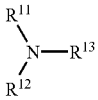

wherein $R^{11}$ and $R^{12}$ are the same or different and each of $R^{11}$ and $R^{12}$ represents a hydrogen atom, a $C_{1-3}$ alkyl, hydroxyalkyl or aminoalkyl group or —(AO)nH, each of A and n has the meaning as mentioned above and $R^{13}$ represents a $C_{5-36}$ alkyl or alkenyl group into which an ester-, amide- or ether-linkage (or bonding group) may be inserted (or which may be interrupted by an ester-, amide- or ether-linkage);

(VII)

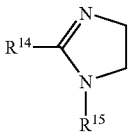

wherein $R^{14}$ represents a $C_{5-36}$ alkyl or alkenyl group into which an ester-, amide- or ether-bonding group may be inserted, $R^{15}$ represents a hydrogen atom, a $C_{1-3}$ alkyl, hydroxyalkyl or aminoalkyl group.

The cationic surfactant (IV) includes a long-chain alkyl trimethyl ammonium chloride, a long-chain alkyl (2-hydroxyethyl) dimethyl ammonium chloride and a long-chain alkyl di(2-hydroxyethyl) methyl ammonium chloride. The number of carbon atoms in the long-chain alkyl group is 5 to 36 and preferably 8 to 18. Then, a coconut alkyl, a tallow alkyl or the like is also preferable.

Further, one in which a long-chain is interrupted (or discontinues) by an ester or amide bond is also preferable. A long-chain alkanoyloxyethyl group, a long-chain alkanoyl amino propyl group, a long-chain alkoxycarbonylmethyl group, a long-chain alkylaminocarbonylmethyl group or the like is preferable in particular. A long-chain alkyl or acyl group has 5 to 36 carbon atoms and preferably 8 to 18 carbon atoms. Then, one which is derived from a coconut oil, a tallow, a palm-stearin or the like is also preferable.

The ampholytic surfactant (V) includes a long-chain alkyl dimethyl betaine, a sulfobetaine, phosphobetaine and a long-chain alkyldimethyl amineoxide. A preferable instance of the long-chain alkyl group is another preferable instance of the long-chain alkyl group in the cationic surfactant (IV).

The amino compound (VI) includes a long-chain alkyl or alkenyl amine, a long-chain alkyl or alkenyl dimethyl amine, a long-chain alkyl or alkenyl di(2-hydroxyethyl) amine or an alkylene oxide adduct and a long-chain alkyl or alkenyl propane diamine. The long-chain alkyl or alkenyl group has preferably 6 to 36 carbon atoms and more preferably 8 to 18 carbon atoms. A coconut alkyl or tallow alkyl is preferable. The long-chain alkyl or alkenyl group into which an ester-, amide- or ether-bonding group may be inserted is preferable. A long-chain alkanoyloxyethyl group, a long-chain alkanoylaminopropyl group, a long-chain alkanoylamihoethyl group, a long-chain alkoxycarbonylmethyl group or a long-chain alkylaminocarbonylmethyl group is preferable, in particular. A long-chain alkyl, alkenyl or acyl group has preferably 6 to 36 carbon atoms and more preferably 8 to 18 carbon atoms. One which has been derived from a coconut oil, a tallow, a palm-stearin or the like is also preferable.

The amino compound (VII) is synthesized by condensing (or concentrating) an N-substituted ethylene diamine such as N-methyl ethylene diamine, N-(2-hydroxyethyl) ethylene diamine and diethylene triamine with a fatty acid and cyclizing the resultant. The number of carbon atoms in an acyl moiety in the fatty acid is preferably 6 to 36 and more preferably 8 to 18. A fatty acid from a coconut, a tallow fatty acid, a hardened tallow fatty acid, stearic acid from a palm or hardened stearic acid from a palm, or a lower alkyl ester thereof is particularly preferable. Further, a fat and/or oil such as a coconut oil, a tallow, a hardened tallow, a palm-stearin and a hardened palm-stearin may also be used.

The salt of the amino compound can be synthesized in a usual manner by neutralizing with an inorganic or organic acid such as hydrochloric acid, sulfuric acid, acetic acid, glycolic acid and citric acid.

The blending ratio of the components (A) and (B-α) in the composition of the present invention is preferably 1/9 to 9/1 and more preferably 5/5 to 8/2 by weight. On the other hand, the blending ratio of the components (A) and (B-β) in the composition of the present invention is preferably 1/9 to 9/1 and more preferably 2/8 to 8/2 by weight.

These components can be formed into the liquid softener composition of the present invention by dispersing them in a total amount of 3 to 50% by weight in water. In this case, the components (A) and (B) may be mixed and then introduced into water or they may be introduced one after another into water. Alternatively, the respective components may be separately dispersed in water and then mixed.

The dispersion of the softener composition of the present invention with water has preferably pH of 2 to 5 in view of a dispersibility and storage stability of the amino compound.

A higher alcohol or higher fatty acid can be added in order to further improve a softening performance. A lower alcohol such as ethanol and isopropanol, glycol or polyol as well as an ethylene oxide or propylene oxide adduct thereof can be added as a storage stabilizer. Furthermore, a usual nonionic surfactant, an inorganic salt, a pH adjuster, a hydrotropic agent, a perfume, a defoaming agent, a pigment and the like can be added if necessary.

Then, a sheetlike-softener for a dryer can be obtained by impregnating them into a sheetlike carrier. The sheetlike carrier used here includes a non-woven fabric.

An impregnating amount in total of the components (A) and (B) mentioned above is preferably 1 to 50% by weight as compared with the sheetlike carrier.

EXAMPLES

Examples 1-1 to 1-6

(A-1) a reacted product of diethanol amine with a hardened tallow fatty acid at the molar ratio of 1:2 as the component (A), (B-1) octadecyl trimethyl ammonium chloride as the component (B) and further (N-1) an adduct with 20 mole of ethylene oxide to dodecyl alcohol as a nonionic compound other than the component (A) were used. They were dispersed in water in amounts shown in Table 1 to prepare each of the softener compositions. This composition was evaluated for a softening effect in the following manner. The results are shown in Table 2.

<A Method for Evaluating a Softening Effect>

① A mixture of the components (A) and (B) and the other component was molten and added dropwise to water under stirring to prepare each of dispersions having the concentration shown in Table 1. As a comparative control sample, a 5% dispersion of N-methyl-N,N-bis(tallow alkanoyloxyethyl)-N-(2-hydroxyethyl) ammonium methyl sulfate was prepared in the same manner as above.

② A Treating Method 2 kg of commercially available cotton towels or 2 kg of jersey cloths made of acrylate fibers were laundered repeatedly 5 times with a commercially available detergent "Attack" (a registered trade mark, manufactured by Kao Corporation) in hard water of 3.5° DH in a laundering machine having its capacity of 30 liter. Then, 25 ml of the above dispersion were introduced thereinto and the resultant mixture was treated under stirring at 25° C. for 1 minute.

③ A Method for Evaluating a Softening Effect

The cloths treated in the method described above were air-dried at room temperature and then left in a constant temperature and humidity chamber at 25° C. under 65% RH for 24 hours. These clothes were evaluated for a softening effect. A cloth treated with N-methy1-N,N-bis(tallow alkanoyl oxyethyl)-N-(2-hydroxyethyl) ammonium methyl sulfate was used as the control for evaluation by the paired comparison test. The results are shown using the following criteria.

+2: Softer than the control.

+1: Somewhat softer than the control.

0: Equal in a softening effect to the control.

−1: Somewhat harder than the control.

−2: Harder than the control.

Examples 2 to 14

The components (A) and (B) mentioned in Table 1 were dispersed in water in amounts shown in Table 1 and then an evaluation for a softening effect was carried out in the same manner as in Example 1. The results are shown in Table 2.

Examples 15-1 to 15-7

Each of softener compositions was obtained by the same manner as in Example 1 except that the above-mentioned (A-1) as the component (A), (B-7) N-(3-hardened tallow alkanoyl aminopropyl)-N,N-dimethylamine as the component (B) were used and that they were dispersed in water in amounts shown in Table 3 and further hydrochloric acid was added dropwise thereto to adjust pH to 2.5. The composition was evaluated for a softening effect in the same manner as in Example 1. The results are shown in Table 4.

Examples 16 to 28

According to the same manner as in Example 15, the components (A) and (B) mentioned in Table 3 were dispersed in water in amounts shown in Table 3. Further, pH of the resultant dispersion was adjusted to one mentioned in Table 3 by using an acid shown in Table 3. Then, an evaluation for a softening effect was carried out in the same manner as in Example 15. The results are shown in Table 4.

Comparative Example 1 to 6

As shown in Table 1, a mixture of the component (A) and a nonionic compound other than the component (A) or only the component (B) was dispersed in water and was evaluated for a softening effect in the same manner as in Example 1. The results are shown in Table 2.

Comparative Examples 7 and 8

As shown in Table 1, the component (B) and an amide linkage-free nonionic compound (C-1 or C-2) were used. Then, an evaluation for a softening eff ect was carried out in the same manner as in Example 1. The results are shown in Table 2.

Comparative Examples 9 to 14

As shown in Table 3, a mixture of the component (A) and the nonionic component (N-1) or only the component (B) was dispersed in water in an amount of shown in Table 3. Further, if necessary, pH of the resultant dispersion was adjusted to onementioned in Table 3 by using an acid shown in Table 3. Then, an evaluation for a softening effect was carried out in the same manner as in Example 1. The results are shown in Table 4.

Comparative Examples 15 and 16

As shown in Table 3, the component (B) and an amide linkage-free nonionic compound (C-1 or C-2) were used. They were dispersed in water in amounts shown in Table 3. Further, pH of the resultant dispersion was adjusted to one mentioned in Table 3 by using an acid shown in Table 3. Then, an evaluation for a softening effect was carried out in the same manner as in Example 1. The results are shown in Table 4.

TABLE 1

| No. of Examples and Comparative Examples | | The component (A) Kind | The component (A) Amount (% by weight) | The component (B) Kind | The component (B) Amount (% by weight) | Nonionic compound other than the component (A) Kind | Nonionic compound other than the component (A) Amount (% by weight) |
|---|---|---|---|---|---|---|---|
| Examples | 1-1 | A-1 | 4.5 | B-1 | 0.5 | | |
| | 1-2 | A-1 | 4.0 | B-1 | 1.0 | | |
| | 1-3 | A-1 | 3.5 | B-1 | 1.5 | | |
| | 1-4 | A-1 | 2.5 | B-1 | 2.5 | | |
| | 1-5 | A-1 | 2.0 | B-1 | 3.0 | | |
| | 1-6 | A-1 | 3.5 | B-1 | 1.5 | N-1 | 1.0 |
| | 2 | A-2 | 3.5 | B-1 | 1.5 | | |
| | 3 | A-3 | 3.5 | B-1 | 1.5 | | |
| | 4 | A-4 | 3.5 | B-1 | 1.5 | | |
| | 5 | A-5 | 3.5 | B-1 | 1.5 | | |
| | 6 | A-1 | 3.5 | B-2 | 1.5 | | |
| | 7 | A-1 | 3.5 | B-3 | 1.5 | | |
| | 8 | A-1 | 3.5 | B-4 | 1.5 | | |
| | 9 | A-1 | 3.5 | B-5 | 1.5 | | |
| | 10 | A-1 | 3.5 | B-6 | 1.5 | | |
| | 11 | A-6 | 3.5 | B-1 | 1.5 | | |
| | 12 | A-6 | 3.5 | B-2 | 1.5 | | |
| | 13 | A-7 | 3.5 | B-1 | 1.5 | | |
| | 14 | A-7 | 3.5 | B-2 | 1.5 | | |
| | 1 | A-1 | 5.0 | | | N-1 | 1.0 |
| Comparative | 2 | A-2 | 5.0 | | | N-1 | 1.0 |
| | 3 | A-3 | 5.0 | | | N-1 | 1.0 |
| Examples | 4 | | | B-1 | 5.0 | | |
| | 5 | | | B-2 | 5.0 | | |
| | 6 | | | B-3 | 5.0 | | |

TABLE 1-continued

| No. of Examples and Comparative Examples | The component (A) Kind | The component (A) Amount (% by weight) | The component (B) Kind | The component (B) Amount (% by weight) | Nonionic compound other than the component (A) Kind | Nonionic compound other than the component (A) Amount (% by weight) |
|---|---|---|---|---|---|---|
| 7 | | | B-1 | 1.5 | C-1 | 3.5 |
| 8 | | | B-1 | 1.5 | C-2 | 3.5 |

Description of the abbreviations in Table 1

A-1: A reacted product of diethanolamine with a hardened tallow fatty acid at the molar ratio of 1:2.

A-2: $RCONH(CH_2CH_2O)_nCOR$ (wherein RCO represents an acyl group derived from a hardened tallow and n is 5 on average.).

A-3: A reacted product of 1-amino-2,3-propanediol with a tallow fatty acid methylester at molar ratio of 1:1.8.

A-4: A reacted product of N-methylglucamine with a hardened tallow fatty acid methylester at the molar ratio of 1:2.3.

A-5: Areacted product of diethanolamine with a hardened tallow fatty acid at the molar ratio of 1:1.2.

A-6: A reacted product of N-methylethanolamine with a hardened tallow fatty acid at the molar ratio of 1:2.

A-7: A reacted product of diisopropanolamine with a hardened tallow fatty acid at the molar ratio of 1:2.

B-1: Octadecyl trimethyl ammonium chloride.

B-2: (2-hardened tallow alkanoyl oxyethyl) trimethyl ammonium chloride.

B-3: (3-coconut-alkanoyl amino propyl) trimethyl ammonium chloride.

B-4: Octadecyloxycarbonyl methyl trimethyl ammonium chloride.

B-5: Octadecyl dimethyl betaine.

B-6: Dodecyl dimethyl amine oxide.

C-1: A reacted product of glycerol with a hardened tallow fatty acid at the molar ratio of 1:2.

C-2: A reacted product of pentaerythritol with a hardened tallow fatty acid at the molar ratio of 1:2.

N-1: An adduct with 20 mole of ethylene oxide to dodecyl alcohol.

TABLE 2

| No. of Examples and Comparative Examples | | Results of evaluations for softening effect: Cotton towels | Results of evaluations for softening effect: Jersey cloths made of acrylate fibers |
|---|---|---|---|
| Examples | 1-1 | +1 | +1 |
| | 1-2 | +1 | +1 |
| | 1-3 | +2 | +1 |
| | 1-4 | +1 | +2 |
| | 1-5 | +1 | +1 |
| | 1-6 | +2 | +1 |
| | 2 | +2 | +1 |
| | 3 | +2 | +1 |
| | 4 | +2 | +2 |
| | 5 | +1 | +1 |
| | 6 | +1 | +1 |
| | 7 | +1 | +2 |
| | 8 | +1 | +1 |
| | 9 | +1 | +1 |
| | 10 | +1 | +2 |

TABLE 2-continued

| No. of Examples and Comparative Examples | | Results of evaluations for softening effect: Cotton towels | Results of evaluations for softening effect: Jersey cloths made of acrylate fibers |
|---|---|---|---|
| | 11 | +2 | +1 |
| | 12 | +1 | +1 |
| | 13 | +2 | +1 |
| | 14 | +1 | +1 |
| Comparative Examples | 1 | −2 | −2 |
| | 2 | −2 | −2 |
| | 3 | −2 | −2 |
| | 4 | −2 | −2 |
| | 5 | −2 | −2 |
| | 6 | −2 | −2 |
| | 7 | −1 | −1 |
| | 8 | −1 | −1 |

TABLE 3

| | | The component (A) Kind | The component (A) Amount (% by weight) | The component (B) Kind | The component (B) Amount (% by weight) | Nonionic compound other than the component (A) Kind | Nonionic compound other than the component (A) Amount (% by weight) | Inorganic or organic acid | pH |
|---|---|---|---|---|---|---|---|---|---|
| Examples | 15-1 | A-1 | 4.5 | B-7 | 0.5 | | | Hydrochloric acid | 2.5 |
| | 15-2 | A-1 | 4.0 | B-7 | 1.0 | | | Hydrochloric acid | 2.5 |
| | 15-3 | A-1 | 3.5 | B-7 | 1.5 | | | Hydrochloric acid | 2.5 |
| | 15-4 | A-1 | 2.5 | B-7 | 2.5 | | | Hydrochloric acid | 2.5 |
| | 15-5 | A-1 | 1.0 | B-7 | 4.0 | | | Hydrochloric acid | 2.5 |
| | 15-6 | A-1 | 0.5 | B-7 | 4.5 | | | Hydrochloric acid | 2.5 |

TABLE 3-continued

| | | The component (A) | | The component (B) | | Nonionic compound other than the component (A) | | | |
|---|---|---|---|---|---|---|---|---|---|
| | | Kind | Amount (% by weight) | Kind | Amount (% by weight) | Kind | Amount (% by weight) | Inorganic or organic acid | pH |
| | 15-7 | A-1 | 2.5 | B-7 | 2.5 | N-1 | 1.0 | Hydrochloric acid | 2.5 |
| | 16 | A-2 | 2.5 | B-7 | 2.5 | | | Hydrochloric acid | 2.2 |
| | 17 | A-3 | 2.5 | B-7 | 2.5 | | | Hydrochloric acid | 2.2 |
| | 18 | A-4 | 2.5 | B-7 | 2.5 | | | Hydrochloric acid | 2.8 |
| | 19 | A-1 | 2.5 | B-8 | 2.5 | | | Sulfuric acid | 2.5 |
| | 20 | A-1 | 2.5 | B-9 | 2.5 | | | Glycolic acid | 4.0 |
| | 21 | A-1 | 2.5 | B-10 | 2.5 | | | Glycolic acid | 4.0 |
| | 22 | A-1 | 2.5 | B-11 | 2.5 | | | Hydrochloric acid | 3.0 |
| | 23 | A-1 | 2.5 | B-12 | 2.5 | | | Citric acid | 4.0 |
| | 24 | A-1 | 2.5 | B-13 | 2.5 | | | Citric acid | 4.3 |
| | 25 | A-6 | 2.5 | B-7 | 2.5 | | | Hydrochloric acid | 2.5 |
| | 26 | A-6 | 2.5 | B-8 | 2.5 | | | Hydrochloric acid | 2.5 |
| | 27 | A-7 | 2.5 | B-7 | 2.5 | | | Hydrochloric acid | 2.5 |
| | 28 | A-7 | 2.5 | B-8 | 2.5 | | | Hydrochloric acid | 2.5 |
| Comparative Examples | 9 | A-1 | 5.0 | | | N-1 | 1.0 | | 2.5 |
| | 10 | A-2 | 5.0 | | | N-1 | 1.0 | | 2.5 |
| | 11 | A-3 | 5.0 | | | N-1 | 1.0 | | 2.5 |
| | 12 | | | B-7 | 5.0 | | | Hydrochloric acid | 2.5 |
| | 13 | | | B-8 | 5.0 | | | Hydrochloric acid | 2.5 |
| | 14 | | | B-13 | 5.0 | | | Hydrochloric acid | 2.5 |
| | 15 | | | B-7 | 2.5 | C-1 | 2.5 | Hydrochloric acid | 2.5 |
| | 16 | | | B-7 | 2.5 | C-2 | 2.5 | Hydrochloric acid | 2.5 |

Description of the abbreviations in Table 3
A-1 to A-4, A-6 and A-7: Mentioned above.
B-7: N-(3-hardened tallow alkanoyl amino propyl)-N,N-dimethyl amine.
B-8: N-(2-hardend alkanoyl oxyethyl)-N,N-dimethyl amine.
B-9: N-octadecyl-N,N-dimethyl amine.
B-10: Octadecyl amine.
B-11: N-hardened tallow alkyl propane diamine.
B-12: N-hardened tallow alkyl-N,N-di(2-hydroxyethyl) amine.
B-13: A condensed cyclic compound with aminoethyl ethanolamine of a hardened tallow fatty acid.
C-1 and C-2: Mentioned above.
N-1: Mentioned above.

TABLE 4

| No. of Examples and Comparative Examples | | Results of evaluations for softening effect | |
|---|---|---|---|
| | | Cotton towels | Jersey cloths made of acrylate fibers |
| Examples | 15-1 | +1 | 0 |
| | 15-2 | +1 | +1 |
| | 15-3 | +2 | +1 |
| | 15-4 | +2 | +2 |
| | 15-5 | +1 | +2 |
| | 15-6 | 0 | +1 |
| | 15-7 | +2 | +2 |
| | 16 | +2 | +1 |
| | 17 | +2 | +1 |
| | 18 | +2 | +2 |
| | 19 | +1 | +2 |
| | 20 | +1 | +2 |
| | 21 | +2 | +2 |
| | 22 | +2 | +1 |
| | 23 | +1 | +1 |
| | 24 | +2 | +2 |
| | 25 | +2 | +2 |
| | 26 | +1 | +2 |
| | 27 | +2 | +2 |
| | 28 | +1 | +2 |
| Comparative Examples | 9 | −2 | −2 |
| | 10 | −2 | −2 |
| | 11 | −2 | −2 |
| | 12 | −2 | −2 |
| | 13 | −2 | −2 |
| | 14 | −2 | −2 |

TABLE 4-continued

| No. of Examples and Comparative Examples | Results of evaluations for softening effect | |
|---|---|---|
| | Cotton towels | Jersey cloths made of acrylate fibers |
| 15 | −1 | −1 |
| 16 | −1 | −1 |

The invention claimed is:

1. A softener composition comprising:

(A) a nonionic compound represented by the following formula (Ia) or (Id), or a mixture thereof:

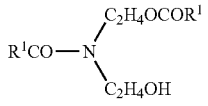

(Ia)

(Id)

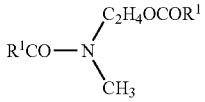

wherein each $R^1$ represents a linear or branched $C_{7-17}$ alkyl or alkenyl group;

(B) an amino compound having one $C_{8-18}$ alkyl or alkenyl group and salts of the compound into which an ester-, amide- or ether- bonding group is optionally inserted; and (C) water;

wherein said softener composition has a pH of 2 to 5; and the ratio of the component (A) to (B) is from 1/4 to 4/1 by weight.

2. The softener composition of claim 1, wherein an ester-, amide- or ether-bonding group is inserted into (B).

3. The softener composition of claim 1, wherein the component (A) is represented by formula (Ia).

4. The softener composition of claim 1, wherein said ratio of the component (A) to (B) is from 2/3 to 7/3.

5. The softener composition of claim 1, further comprising a higher alcohol, and/or a higher fatty acid.

6. The softener composition of claim 1, wherein an amide-bonding group is inserted into (B).

7. The softener composition of claim 1, wherein said ratio of The component (A) to (B) is from 1/4 to 1/1.

8. The softener composition of claim 1, wherein said ratio of the component (A) to (B) is from 1/1 to 4/1.

9. The softener composition of claim 1, wherein the component (B) is an amino compound represented by the formula (VI) or a salt thereof:

(VI)

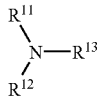

wherein $R^{11}$ and $R^{12}$ are the same or different and each of $R^{11}$ and $R^{12}$ represents a hydrogen atom, a $C_{1-3}$ alkyl, hydroxyalkyl or aminoalkyl group or -(AO)nH, wherein each of A and n represents a number selected from 1 to 10, and $R^{13}$ represents a $C_{8-18}$ alkyl or alkenyl group into which an ester-, amide- or ether- bonding group is optionally inserted.

10. The softener composition of claim 9, wherein said amino compound of formula (VI) has a long-chain alkyl or alkenyl group having 8 to 18 carbon atoms.

11. A sheetlike softener for a dryer, which is obtained by impregnating an amount of the softener composition of claim 1 into a sheetlike carrier.

12. The sheetlike softener of claim 11, where said impregnating amount of the softener composition is 1 to 50% by weight as compared with the sheetlike carrier.

13. A softener composition comprising:

(A) a nonionic compound represented by the following formula (Ia) or (Id), or a mixture thereof:

(Ia)

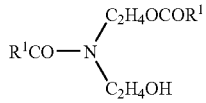

wherein each $R^1$ represents a liner or branched $C_{7-17}$ alkyl or alkenyl group; and (Id)

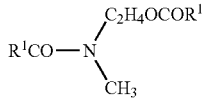

(B) an amino compound is represented by formula (VI) or a salt thereof:

(VI)

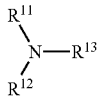

wherein $R^{11}$ and $R^{12}$ are the same or different and each of $R^{11}$ and $R^{12}$ represents a hydrogen atom, a $C_{1-3}$ alkyl, hydroxyalkyl or aminoalkyl group or -(AO)nH, wherein each of A and n represents a number selected from 1 to 10, and $R^{13}$ represents a $C_{8-18}$ alkyl or alkenyl group into which an ester-, amide- or ether- bonding group is optionally inserted;

wherein the ratio of the component (A) to (B) is from 1/4 to 4/1 by weight.

14. The softener composition of claim 13, wherein the component (A) is represented by formula (Ia).

15. The softener composition of claim 13, wherein component (A) is represented by formula (Id).

16. The softener composition of claim 13, wherein an amide-bonding group is inserted into (B).

17. The softener composition of claim 13, wherein said ratio of The component (A) to (B) is from 1/4 to 1/1.

18. The softener composition of claim 13, wherein said ratio of the component (A) to (B) is from 1/1 to 4/1.

* * * * *